US007427061B2

(12) United States Patent
Ruthenberg et al.

(10) Patent No.: US 7,427,061 B2
(45) Date of Patent: Sep. 23, 2008

(54) RETARD FEEDER

(75) Inventors: Raymond Matthew Ruthenberg, Toronto (CA); Joseph Andre Michel Loiselle, Brampton (CA)

(73) Assignee: Xerox Corporation, Norwalk, CT (US)

( * ) Notice: Subject to any disclaimer, the term of this patent is extended or adjusted under 35 U.S.C. 154(b) by 147 days.

(21) Appl. No.: 11/524,606

(22) Filed: Sep. 21, 2006

(65) Prior Publication Data

US 2008/0073825 A1 Mar. 27, 2008

(51) Int. Cl.
*B65H 3/52* (2006.01)
*B65H 7/02* (2006.01)

(52) U.S. Cl. ..... 271/122; 271/125; 271/258.04

(58) Field of Classification Search ..... 271/258.04, 271/272, 256, 122, 125, 121
See application file for complete search history.

(56) References Cited

U.S. PATENT DOCUMENTS 4,203,586 A 5/1980 Hoyer
4,306,713 A * 12/1981 Avritt et al. ..... 271/37
4,368,881 A 1/1983 Landa
5,039,080 A 8/1991 Kato et al.
5,313,253 A * 5/1994 Martin et al. ..... 399/16
5,435,538 A 7/1995 Billings et al.
5,435,540 A * 7/1995 Martin et al. ..... 271/122
2003/0044206 A1 * 3/2003 Brown ..... 399/353
2003/0106757 A1 * 6/2003 Johnson et al. ..... 192/30 W

FOREIGN PATENT DOCUMENTS

JP 59102737 A * 6/1984

OTHER PUBLICATIONS

U.S. Appl. No. 11/266,401, filed Nov. 3, 2005 by Barry P. Mandel et al., Friction Retard Sheet Feeder.
U.S. Appl. No. 11/158,092, filed Jun. 21, 2005 by Nidhi Sharma et al., Paper Feeder.

* cited by examiner

*Primary Examiner*—Patrick Mackey
*Assistant Examiner*—Luis A Gonzalez

(57) ABSTRACT

A semi-active retard feeder employs a hysteresis clutch to provide the resisting torque to a retard roll. A low cost Hall Effect sensor is added to the clutch assembly to provide a feedback signal during the feeding cycle in order to detect the onset of degraded feeding performance. This signal can be used to instruct a user to order and replace the retard roll.

20 Claims, 3 Drawing Sheets

RETARD FEEDER

This invention relates in general to an image forming apparatus, and more particularly, to an image forming apparatus including an improved semi-active retard (SAR) feeder.

Heretofore, paper feeders in printers have used magnetic particle brakes, wrap spring clutches and hysteresis clutches in active and semi-active feed heads. In these feed head systems, the drag torque is fixed. Thus, the design intent torque is a compromise between the ideal torque for various media types and across various environmental conditions, which results in less than optimum paper feeding performance. These retard feeders rely on an elastomeric retard roll to prevent feeding multiple sheets. This roll must use a material that has a high coefficient of friction and be resistant to contamination. Typically, this results in the use of materials with a high wear rate. The resisting force that the retard roll imparts to the feed nip is a product of the normal force and the coefficient of friction of the material, and has an upper limit which is set by the resisting torque applied to the retard roll.

Typical implementation of retard feeders of this type includes creating a normal force on the nip which is constant over a large range and provide sufficient material on the retard roll to wear. The rolls used in the SAR feeders are typically soft elastomers which wear over life. This results in a reduction in diameter of the retard roll. This diameter reduction when coupled with the fixed torque of the slip clutch results in an increase in force at the nip to turn the retard roll. As the retard roll wears, SAR feeders reach a point where the retard roll stops rotating. Subsequent feeding wears a flat spot in the retard roll. This is followed by reduced capability to separate sheets (multifeeding) and lead edge damage. This results in a retard roll that must be replaced more often than is desirable. These systems typically do not have feedback and the common implementation is to monitor feeds against a set replacement interval.

The following disclosures included herein by reference to the extent necessary to practice the present disclosure may be relevant to various aspects of the present disclosure: U.S. Pat. No. 5,039,080 to Kato et al.; U.S. Pat. No. 4,368,881 to Landa; U.S. Pat. No. 4,203,586 to Hoyer; U.S. Pat. No. 5,435,538 to Billings, et al.; U.S. patent application Ser. No. 11/266,401 filed Nov. 3, 2005, Publication No. 20070096385, by Barry P. Mandel et al., FRICTION RETARD SHEET FEEDER; and U.S. patent application Ser. No. 11/158,092 filed Jun. 21, 2005, Publication No. 20070001371, by Nidhi Sharma et al., PAPER FEEDER.

Portions of the foregoing disclosures may be briefly summarized as follows. U.S. Pat. No. 5,039,080 describes a sheet feeding apparatus having a feed roller and a separating roller forming a nip utilizing a rotation resisting torque limiter and a spring to resiliently urge the separating roller in the reverse direction when a double fed sheet is in the nip. U.S. Pat. No. 4,368,881 discloses a top feed friction retard feeder that utilizes a spring loaded retard roll and a torque limiter to bias the reverse rotation at a predetermined torque level. U.S. Pat. No. 4,203,586 describes a multi-feed detection system including a drag roll in contact with a feed belt wherein a slip clutch applies a torque to the drag roll. A double fed sheet causes the drag roll to hesitate which is then detected by a sensor to activate a shut down as a result of the double fed sheet. U.S. Pat. No. 5,435,586 describes a retard sheet feeder that utilizes a slip clutch with an integral biasing device to separate double sheets. U.S. patent application Ser. No. 11/266,401 discloses a retard feeder that includes a drive roll and a retard roll. The drive roll and the retard roll include a feed nip therebetween for driving the sheets at a velocity. A first drive system is provided to selectively drive the drive roll and at least one nudger roll in a forward direction. A second drive system drives the retard roll through a slip clutch having a torque such that the slip clutch torque allows the retard roll to rotate at substantially the same velocity as the drive roll when only one sheet is in the feed nip. The retard feeder further includes a motion sensor for detecting a signal when the retard roll stops rotating at the velocity of the drive roll corresponding to when more than one sheet is in the feed nip. The second drive system can selectively vary the velocity of the retard roll in response to the signal from the retard roll motion sensor. U.S. patent application Ser. No. 11/158,092 discloses a retard roll mounted on a shaft that is controlled by a magneto Theological variable clutch. Current-is adjusted to the magneto rheological variable clutch to produce a variable drag torque (from near zero to fully locked) on the retard roll. The current is adjusted based on various inputs, some of which include media type, temperature, humidity, media size, and transport speed. Variable drag on the retard roll results in a reduction in induced skew of sheet passing through a nip formed between the retard roll and a separation roll, as well as, less and more consistent wear of the retard roll.

Pursuant to an aspect of the disclosure, there is provided an apparatus adapted to separate and advance media sheets comprising a media sheet advancing device including a drive roll and a retard roll wherein the drive roll and the retard roll include a feed nip therebetween for driving the media sheets at a velocity. A drive system is provided to selectively drive the drive roll in a forward direction. Friction in the nip between the retard roll and the drive roll drives the retard roll through a slip clutch having a torque wherein the slip clutch torque allows the retard roll to rotate at substantially the same velocity as the drive roll when a single media sheet is in the nip. A motion sensor is provided for detecting when the forces imparted at the retard roll surface by the slip clutch are exceeded by the frictional force imparted by the media causing the retard roll to stall.- The motion sensor is monitored and the detected stall signal is used to alert the user to replace the retard roll prior to the onset of unacceptable jam rates.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposes or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example below, and the claims. Thus, they will be better understood from this description of the specific embodiment, including the drawing figures (which are approximately to scale) wherein:

Figure 1:
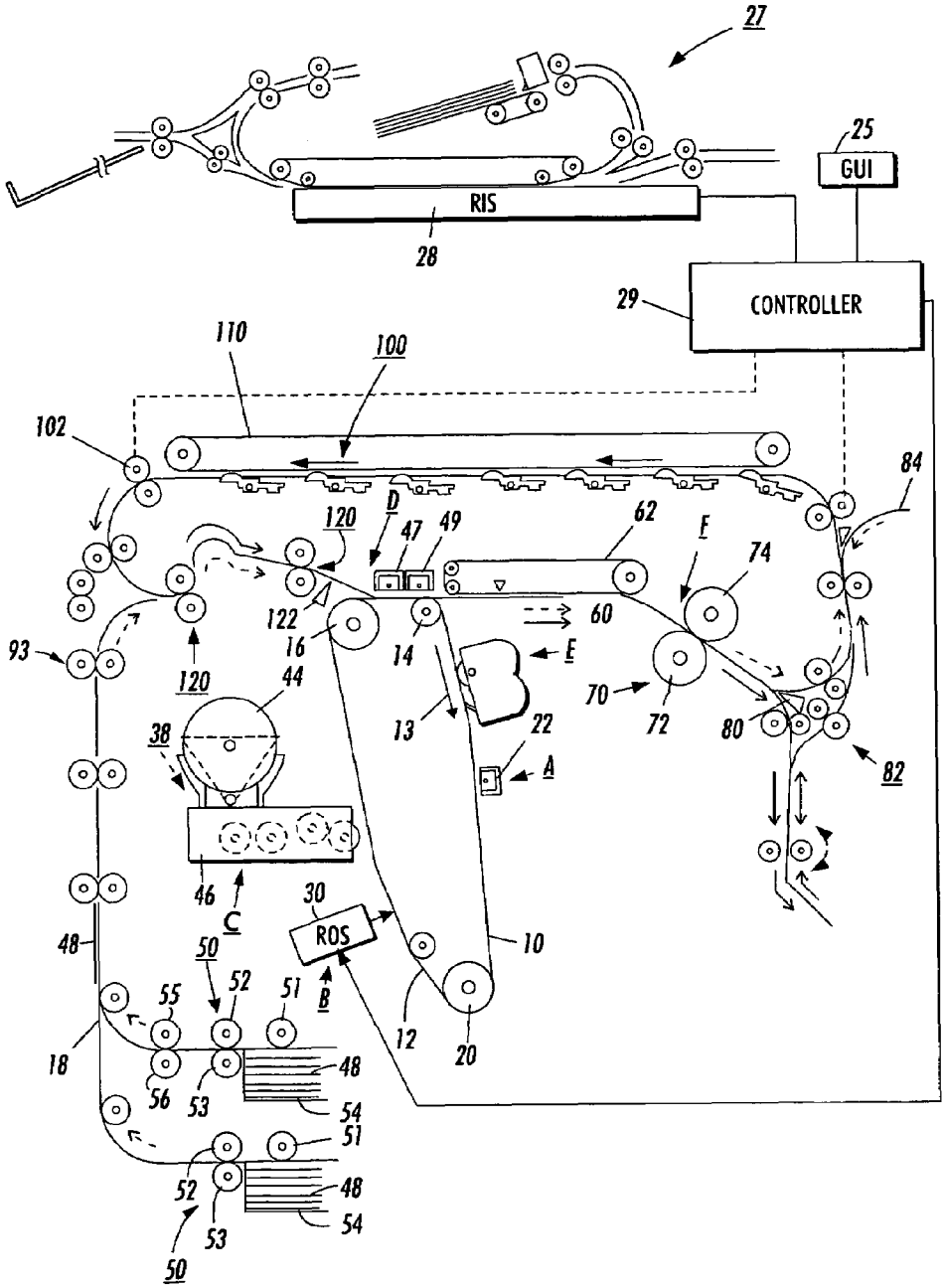
FIG. 1 is an elevation view of an exemplary xerographic printer that includes the improved retard feeder system of the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a xerographic printing apparatus that includes an improved retard feeder apparatus.

For a general understanding of the features of the disclosure, reference is made to the drawings. In the drawings, like reference numerals have been used throughout to identify identical elements.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge couple device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station D, by a sheet feeding apparatus, 50. Preferably, sheet feeding apparatus 50 includes a nudger roll 51 which feeds the uppermost sheet of stack 54 to a nip formed by feed roll 52 and a retard roll 53. Retard roll 53 is mounted on shaft 91 and controlled by controller 29 through a hysteresis clutch 86 that will be described hereinafter. Feed roll 52 rotates to advance the sheet from stack 54 into vertical transport 18. Vertical transport 18 directs the advancing sheet 48 of support material into the registration transport 120 which, in turn, advances the sheet 48 past image transfer station D to receive an image from photoconductive belt 10 in a timed sequence so that the toner powder image formed thereon contacts the advancing sheet 48 at transfer station D. Transfer station D includes a corona generating device 47 which sprays ions onto the back side of sheet 48. This attracts the toner powder image from photoconductive surface 12 to sheet 48. The sheet is then detacked from the photoreceptor by corona generating device 49 which sprays oppositely charged ions onto the back side of sheet 48 to assist in removing the sheet from the photoreceptor. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is canned against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher of stacker, or deflects the sheet into the duplex path 100, specifically, first into single sheet inverter 82 here. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transport 110, for recirculation back through transport station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor that controls all of the machine functions hereinbefore described. The controller provides a comparison count of the copy sheets, the number of documents being recirculated, the number of documents being recirculated, the number of copy sheets selected by the operator, time delays, jam corrections, receive signals from full width or partial width array sensors and calculate skew in sheets passing over the sensors, calculate the change in skew, the speed of the sheet and an overall comparison of the detected motion of sheets with a reference or nominal motion through a particular portion of the machine.

Figure 2:
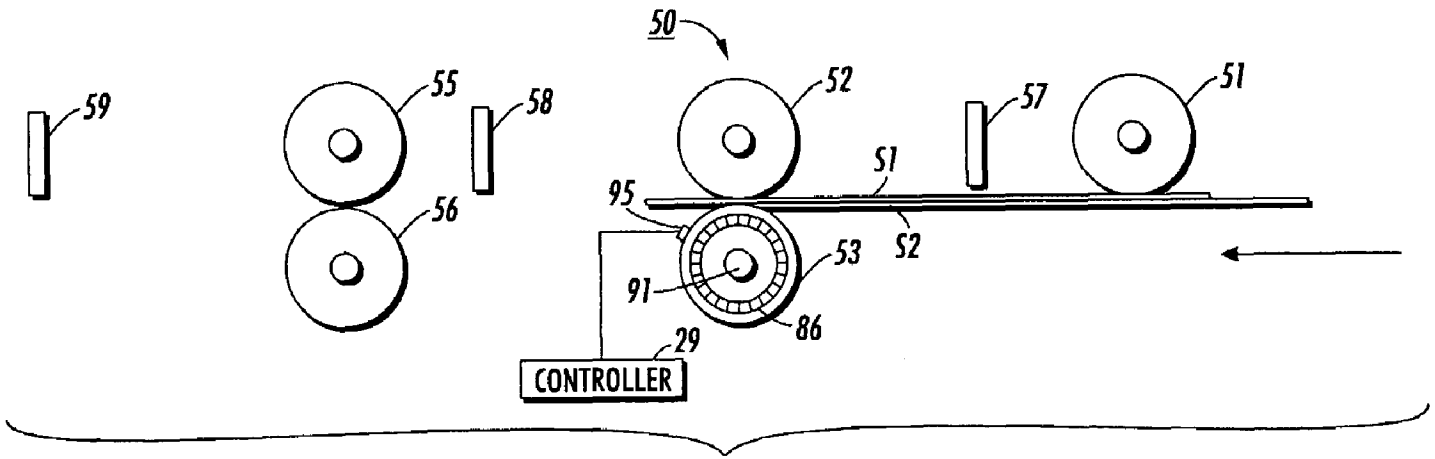
FIG. 2 is an exploded, partial schematic side view of a one embodiment of the improved retard sheet feeder apparatus of the disclosure.

Sheet separator/feeder 50 is a semi-active friction retard top sheet feeder that will now be described with particular reference to FIGS. 1 and 2. Sheets 48 are fed from a stack by nudger roll 51 which engages the top sheet in the stack, and on rotation feeds the top sheet towards a nip formed between separation or feed roll 52 and retard roll 53. Feeding from tray 54 by nudger roll 51 is obtained by creating a stack normal force (e.g., of 1.5 Newtons) between the nudger roll and the paper stack. This force is achieved by the weight of the nudger wheel and its associated components acting under gravity At the beginning of a print cycle, the machine logic will interrogate the system to determine if any paper is in the paper path. If there is no paper in the paper path, the logic will initiate a signal to a feed clutch in nudger 51, thereby starting the feeder. The nudger roll 51 will drive the top sheet of paper 48 into the nip between feed roll 52 and retard roll 53. Microswitch 57 indicates when a sheet has been forwarded by the nudger roll. As the feed roll rotates, it drags a sheet of paper from the stack. Frictional forces and static electricity between the sheets of paper in the stack may cause several sheets to move into the nip together.

If several sheets of paper approach the nip together, the friction between the retard roll 53 and the bottom sheet of those being fed is greater than that between two sheets. The friction between the feed roll 52 and the top sheet S1 is greater than the friction between two sheets. The group of sheets being fed towards the nip will therefore tend to become staggered around the curved surface of the retard roll up into the nip, until the lower sheet S2 of the top two sheets is retained by the retard roll 53, while the topmost sheet is fed by the feed roll 52. Of course, in order for this to happen, the friction between the feed roll 52 and a paper sheet must be greater than the friction between a paper sheet and the retard roll 53. Therefore, the feed roll 52 drives the top sheet S1 away from the stack, and the next sheet S2 is retained in the nip to be fed next. Microswitch 58 communicates to controller 29 whether a sheet has reached that point in feeding.

The feed clutch remains energized until paper is sensed by the input microswitch 59. Paper whose leading edge has reached this switch 59 is under the control of the takeaway rolls 55, 56 that drive the sheet towards registration transport 120.

Figure 3:
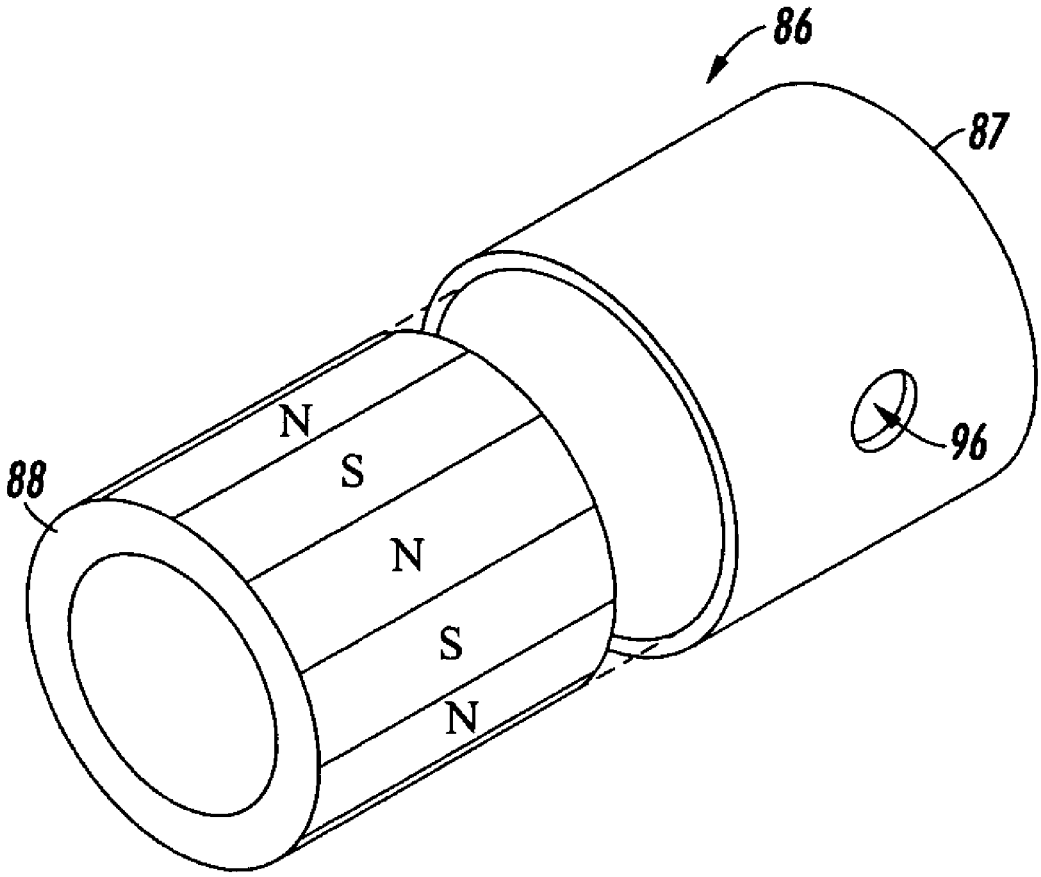
FIG. 3 is an exploded, partial schematic elevation view of working portions of a hysteresis clutch.

Under normal conditions, elastomer covered retard roll 53 will rotate with a sheet during a single sheet feed. As the retard roll wears and the roll diameter decreases, the force imparted at the roll surface by the torque-limiting hysteresis clutch 86 proportionately increases. As shown in FIG. 3, torque-limiting hysteresis clutch 86 includes a permanent magnet rotor 88 with multiple poles and a metal cylinder 87 positioned thereover. Rotation of the rotor relative to the cylinder creates a changing magnetic field. This induces currents in the cylinder, which oppose the motion producing the retard torque. At a certain point, the torque limiting force on the retard roll exceeds the frictional force imparted by the sheet. This causes the retard roll to stall, and the subsequent flat-spot wear on the roll eventually results in either multiple sheet being fed or lead to edge damage. To prevent this by detecting the onset of stall, Hall Effect sensor 95 is employed. The Hall Effect sensor 95 is positioned adjacent to an outer surface of the torque limiting clutch and a hole 96 in metal cylinder 87 allows the Hall Effect sensor to monitor the motion of retard roll 53 during feeder operation. An example of a preferable Hall Effect sensor is marketed by Panasonic under part number DN6847/SE/S. Once stall occurs, a signal is sent by Hall Effect sensor 95 to controller 29 which in turn through GUI 25 notifies an operator to order and replace the roll set before unacceptable event rates occur. Use of Hall Effect sensors is preferable to optical encoder type sensors due to a substantial cost advantage.

While hysteresis clutch 86 is shown as a separate component and not integral with retard roll 53, an integral retard roll, hysteresis clutch and Hall Effect sensor in one device is within the scope of the disclosure.

It should now be understood that an improved retard paper feed system has been disclosed that employs a controllable torque device in the separation nip. The Controllable torque device is a torque-limiting hysteresis clutch 86 coupled to a retard roll. A Hall Effect sensor 95 is positioned adjacent to the outer surface of the clutch to monitor any stall by the retard roll during the feeding process which will indicate excessive wear of the retard roll. Once the sensor senses stall in the motion of the retard roll, a signal is sent to a controller which sends a signal to a graphic user interface. The graphic user interface alerts an operator to the need to order and replace the roll set prior to the onset of unacceptable jam rates.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A reprographic device, comprising:

a scanning member for scanning a document;

an image processor that receives image data from said scanning member and processing it;

a retard sheet feeder, said retard sheet feeder including a retard roll and a separation roll that form a nip therebetween to feed copy sheets to receive images thereon from said image processor, said retard sheet feeder including a clutch mechanism coupled to said retard roll that applies a stable torque to said retard roll;

a Hall Effect sensor positioned adjacent an outer surface of said clutch to monitor motion of said clutch and thereby any stall of said retard roll during the feeding process which will indicate excessive wear of said retard roll; and a controller adapted to receive a signal from said Hall Effect sensor and alert an operator to order and replace the retard roll.

2. The reprographic device of claim 1, wherein said clutch mechanism includes a hysteresis clutch.

3. The reprographic device of claim 2, wherein said hysteresis clutch includes a permanent magnet rotor and a magnetic cylinder.

4. The reprographic device of claim 3, wherein said metal cylinder includes a hole therein through which said Hall Effect sensor monitors motion of said rotor and thereby motion of said retard roll.

5. The reprographic device of claim 4, including a nudger roll and a first microswitch to indicate when a sheet has been forwarded by said nudger roll.

6. The reprographic device of claim 5, including a second microswitch that sends a signal to said controller when a sheet reaches that point in feeding.

7. The reprographic device of claim 1, including a graphic user interface adapted to receive a signal from said controller and display an alert message to an operator.

8. The reprographic device of claim 1, wherein said retard roll includes an elastomeric outer surface.

9. An electrostatographic printing apparatus, comprising:

a document handler that receives and feeds documents from a feed tray along a predetermined feed path;

a scanning member positioned to read an image on each document fed through said predetermined feed path and forward image data for further processing;

an image processor that receives the image data from said scanning member and processes it;

a retard sheet feeder, said retard sheet feeder including a retard roll and a separation roll that form a nip therebetween to feed copy sheets to receive images thereon from said image processor, said retard sheet feeder including a clutch mechanism coupled to said retard roll that applies a stable torque to said retard roll;

a motion sensor positioned opposite an outer surface of said clutch mechanism and adapted to monitor motion of said clutch and thereby stall of said retard roll during the feeding process which will indicate excessive wear of said retard roll; and a controller adapted to receive a stall signal from said motion sensor and send an alert signal to an operator to order and replace the retard roll.

10. The electrostatographic printing apparatus of claim 9, wherein said motion sensor is a Hall Effect sensor.

11. The reprographic device of claim 9, wherein said clutch mechanism includes a hysteresis clutch.

12. The reprographic device of claim 11, wherein said hysteresis clutch includes a permanent magnet rotor and a magnetic cylinder.

13. The reprographic device of claim 12, wherein said magnetic cylinder of said hysteresis clutch includes a hole therein through which said Hall Effect sensor monitors motion of said rotor and thereby motion of said retard roll.

14. The reprographic device of claim 13, including a nudger roll and a first microswitch to indicate when a sheet has been forwarded by said nudger roll.

15. The reprographic device of claim 14, including a second microswitch that sends a signal to said controller when a sheet reaches that point in feeding.

16. A method in a retard feeder for monitoring wear of a retard roll, comprising:

providing a retard sheet feeder, said retard sheet feeder including a retard roll and a separation roll that form a nip therebetween to feed copy sheets to receive images thereon from an image processor, said retard sheet feeder including a clutch mechanism that applies a stable torque to said retard roll;

providing a motion sensor positioned opposite an outer surface of said clutch mechanism and adapted to monitor motion of said clutch and thereby stall of said retard roll; and providing a controller adapted to receive a stall signal from said motion sensor and send an alert signal to an operator to order and replace the retard roll during the feeding process which will indicate excessive wear of said retard roll.

17. The method of claim 16, wherein said clutch mechanism includes a hysteresis clutch.

18. The method of claim 17, wherein said hysteresis clutch includes a permanent magnet rotor and a magnetic cylinder.

19. The method of claim 18, wherein magnetic cylinder of said hysteresis clutch includes a hole therein through which said Hall Effect sensor monitors motion of said rotor and thereby motion of said retard roll.

20. The method of claim 19, including a nudger roll and a first microswitch to indicate when a sheet has been forwarded by said nudger roll.

* * * * *